US011779075B2

(12) United States Patent
Frejd

(10) Patent No.: US 11,779,075 B2
(45) **Date of Patent: *Oct. 10, 2023**

(54) PROTECTIVE HEADGEAR WITH ADJUSTABLE AIR SUPPLY

(71) Applicant: 3M INNOVATIVE PROPERTIES COMPANY, St. Paul, MN (US)

(72) Inventor: Jonas N. A. Frejd, Falun (SE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/569,573

(22) Filed: Jan. 6, 2022

(65) Prior Publication Data

US 2022/0125150 A1 Apr. 28, 2022

Related U.S. Application Data

(63) Continuation of application No. 16/648,188, filed as application No. PCT/IB2018/056889 on Sep. 10, 2018, now Pat. No. 11,253,022.

(60) Provisional application No. 62/561,905, filed on Sep. 22, 2017.

(51) Int. Cl.
*A42B 3/28* (2006.01)
*A42B 3/04* (2006.01)

(52) U.S. Cl.
CPC ..... *A42B 3/288* (2013.01); *A42B 3/042* (2013.01)

(58) Field of Classification Search
CPC ..... A61F 9/06; A62B 18/08; A42B 3/042; A42B 3/286; A42B 3/288
See application file for complete search history.

(56) References Cited

U.S. PATENT DOCUMENTS

| | | | | |
|---|---|---|---|---|
| 3,535,707 | A | 10/1970 | Greenlee | |
| 5,283,914 | A | 2/1994 | James | |
| 6,393,617 | B1 | 5/2002 | Paris | |
| 7,534,005 | B1 | 5/2009 | Buckman | |
| 8,104,094 | B2 | 1/2012 | Uttrachi | |
| 9,038,199 | B2 | 5/2015 | Becker | |
| 9,510,632 | B2 * | 12/2016 | Perusse | A62B 18/003 |
| 9,999,546 | B2 | 6/2018 | Gardner | |
| 11,253,022 | B2 * | 2/2022 | Frejd | A42B 3/288 |
| 2006/0101557 | A1 | 5/2006 | Klotz | |
| 2006/0203148 | A1 | 9/2006 | Magnusson | |
| 2009/0055987 | A1 | 3/2009 | Becker | |
| 2009/0089908 | A1 | 4/2009 | Huh | |
| 2010/0294270 | A1 | 11/2010 | Curran | |
| 2011/0265790 | A1 | 11/2011 | Walker | |

(Continued)

FOREIGN PATENT DOCUMENTS

| | | |
|---|---|---|
| EP | 2129443 | 12/2009 |
| EP | 2205324 | 7/2010 |

(Continued)

OTHER PUBLICATIONS

3M Welding Safety Catalog 2016, 68 pages.
International Search Report for PCT International Application No. PCT/IB2018/056889, dated Dec. 5, 2018, 5 pages.

*Primary Examiner* — Katherine M Moran
(74) *Attorney, Agent, or Firm* — Kenneth B. Wood

(57) ABSTRACT

Protective headgear including central, left lateral, and right lateral trunks, and which may include at least one external, remote handle for directing air flow.

19 Claims, 8 Drawing Sheets

(56) References Cited

U.S. PATENT DOCUMENTS

| | | | | |
|---|---|---|---|---|
| 2014/0013479 | A1* | 1/2014 | Magnusson | A61F 9/067<br>2/8.7 |
| 2015/0083134 | A1* | 3/2015 | Walker | A62B 17/04<br>128/204.21 |
| 2015/0359680 | A1 | 12/2015 | Gardner | |

FOREIGN PATENT DOCUMENTS

| | | |
|---|---|---|
| EP | 2209530 | 7/2010 |
| EP | 2790793 | 10/2014 |
| WO | WO 2015-195496 | 12/2015 |
| WO | WO 2016-069342 | 5/2016 |
| WO | WO 2016-126587 | 8/2016 |

* cited by examiner

PROTECTIVE HEADGEAR WITH ADJUSTABLE AIR SUPPLY

BACKGROUND

Protective headgear, e.g. eye-protective headgear, often find use in operations such as welding, grinding, and the like.

SUMMARY

In broad summary, herein is disclosed protective headgear comprising an air supply module comprising central, left lateral, and right lateral trunks, and which may comprise at least one external, remote handle for directing air flow. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated.

Figure 1:
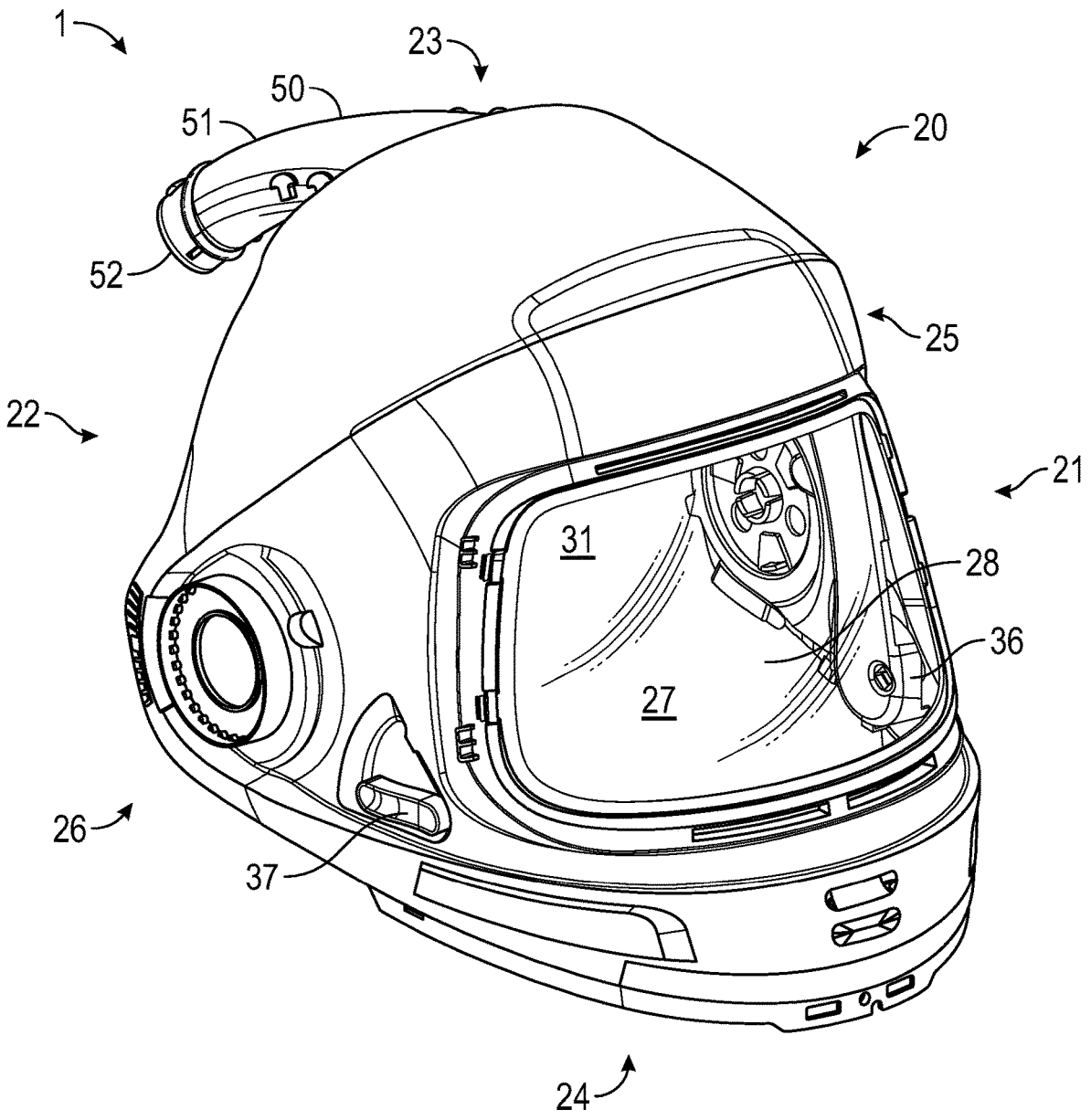
FIG. 1 is a front-right side perspective view of an exemplary protective headgear comprising a protective helmet with an air supply module mounted therein.
Figure 4:
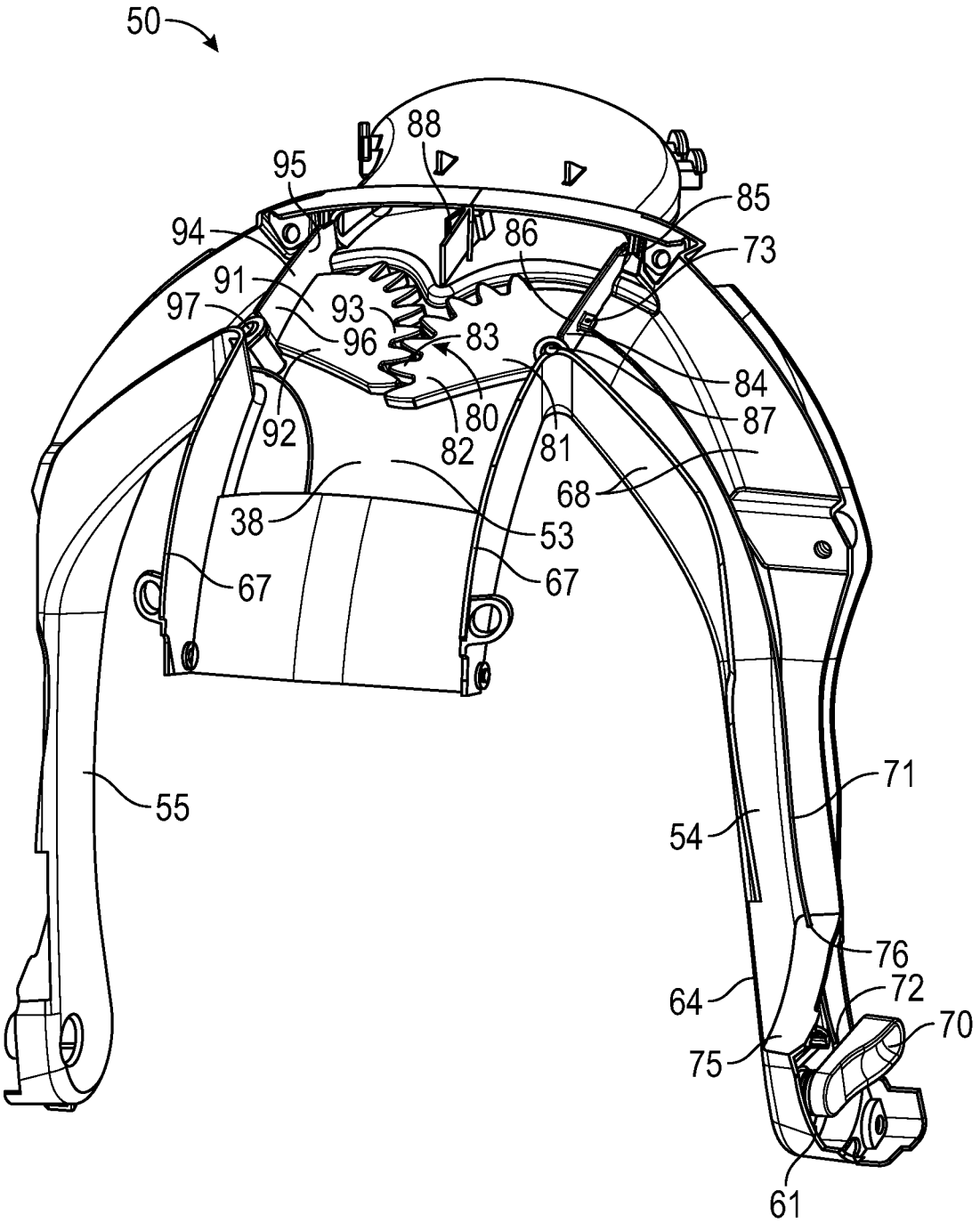
FIG. 4 is a front-left side perspective view of an exemplary air supply module, with an exemplary air valve of the air supply module in a configuration in which air is directed to enter a central air supply passage of the air supply module.

Although terms such as first and second may be used in this disclosure, it should be understood that those terms are used in their relative sense only unless otherwise noted. Terms such as upward, downward, upper, lower, above, beneath, and so on, have their ordinary meaning with respect to a protective headgear that is fitted on the head of a wearer who is in an upright posture. Terms such as inward, outward, front, forward, forwardmost, rear, rearward, rearwardmost, left and right, likewise have their ordinary meaning with respect to a protective headgear fitted on the head of a wearer. (Thus, for example, FIG. 1 is a right-front view of a headgear; FIG. 4 is a left-front view of an air supply module.) The term lateral encompasses left-right directions and locations (e.g. a lateral air passage may be either a right air passage or a left air passage). The terms external, remote, and remotely connected, are defined and described in detail later herein.

As used herein as a modifier to a property or attribute, the term generally, unless otherwise specifically defined, means that the property or attribute would be readily recognizable by a person of ordinary skill but without requiring a high degree of approximation (e.g., within +/−20% for quantifiable properties). The term substantially, unless otherwise specifically defined, means to a high degree of approximation (e.g., within +/−5% for quantifiable properties). The term essentially means to a very high degree of approximation (e.g., within plus or minus 2% for quantifiable properties); it will be understood that the phrase at least essentially subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match.

DETAILED DESCRIPTION

Herein is disclosed a protective headgear 1. As shown in exemplary embodiment in the front-right perspective view of FIG. 1, exemplary protective headgear 1 comprises a protective helmet 20 that (with headgear 1 as conventionally worn by a person) comprises a forward side 21, a rearward side 22, an upward or top side 23 (e.g., toward the crown of a wearer's head), and a bottom side 24 (e.g., toward the user's neck). Helmet 20 further comprises a left side 25 (denoted from the point of view of a user wearing the headgear) and a right side 26. Helmet 20 defines a downwardly-open-ended interior space 31, and comprises an inward major surface 32 as discussed later herein. Helmet 20 may have a closed rear side or an open rear side, and in particular it may have an at least partially open rear side to which may be fitted a flexible (e.g. fabric) rear cover, as discussed later herein.

Helmet 20 may take any suitable form; e.g. it may be a rigid shell (e.g. with a Shore A hardness of at least about 60, 70, 80, or 90) made of an organic polymeric injection-molded material or of metal (e.g. steel or aluminum). In some embodiments helmet 20 may comprise an inner core layer made of e.g. metal that is sandwiched between outer layers of an organic polymeric material. In some embodiments helmet 20 may be made of an organic polymeric material (e.g. an injection-molded material) without including any layer or component made of metal (or any electrically conductive material). In some embodiments, helmet 20 may comprise a single-wall construction e.g. in which the wall of helmet 20 exhibits a monolithic structure. In other embodiments, at least a portion of helmet 20 may comprise a double-wall construction (e.g. comprising two walls separated by an airspace therebetween, with an inner surface of the inner wall providing inward major surface 32 of helmet 20).

Forward side 21 of helmet 20 comprises an optically-transmissive window (opening) 27, into which is fitted a protective windowpane 28, which provides at least physical protection (e.g., protection from liquid splashes, from particulate debris, and so on) for a wearer of the headgear. Windowpane 28 is light-transmissive to allow the wearer of the headgear to be able to see through windowpane 28 (although in certain specific embodiments, windowpane 28 may be capable of being darkened in response to high-intensity light, as discussed later herein). In various embodiments windowpane 28 may be made of e.g. polycarbonate, glass, and so on; in some embodiments it may be a multi-layer structure (e.g. safety glass). In some embodiments, windowpane 28 may be at least generally planar; in other embodiments, windowpane 28 may be curved as in FIG. 1. In some embodiments, protective headgear 1 may comprise a suspension (a suspension is omitted from FIG. 1 for ease of observation of other components of the headgear), as discussed later herein.

Figure 2:
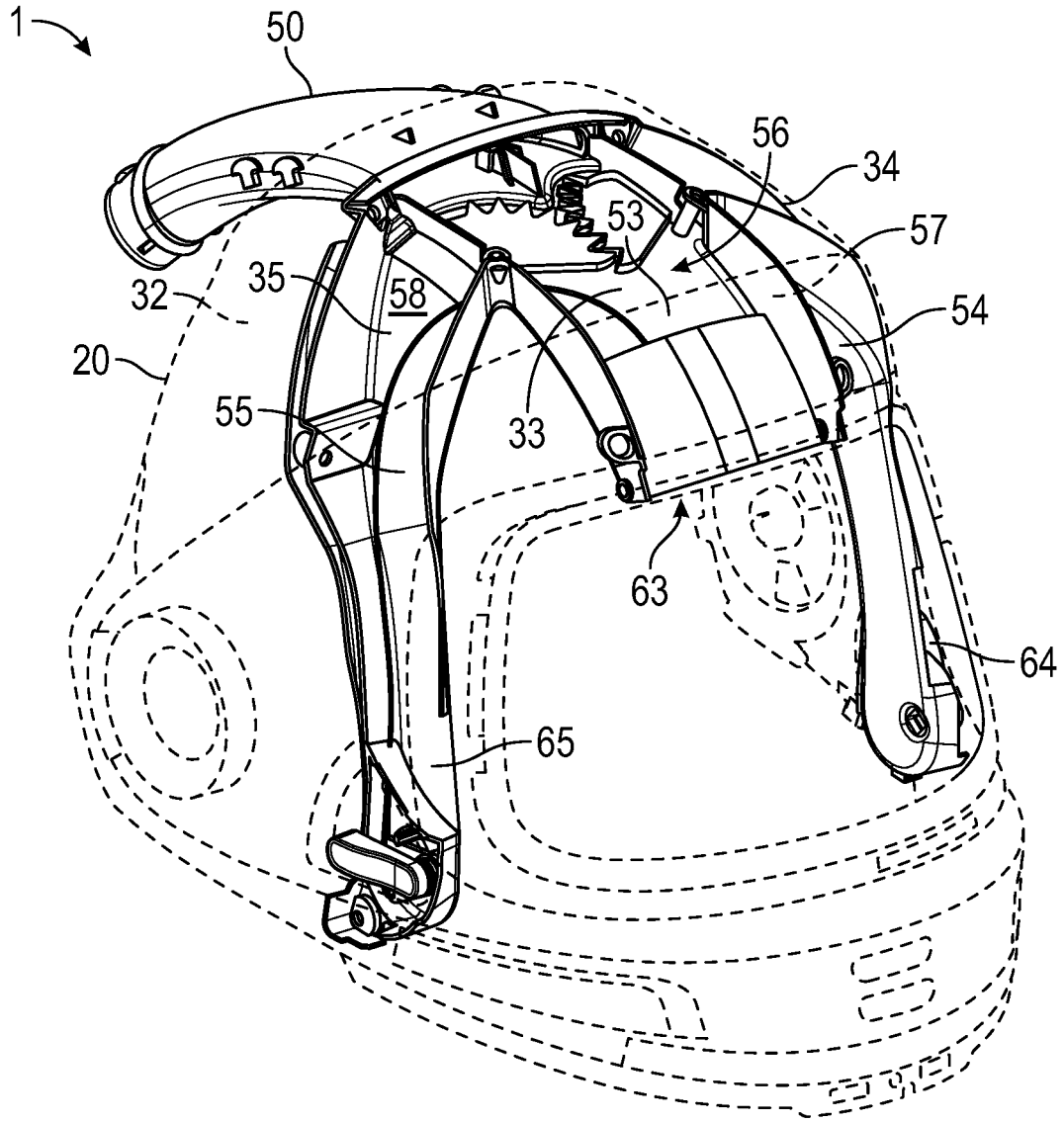
FIG. 2 is a front-right side perspective view of the headgear of FIG. 1, with the exemplary air supply module made more visible by showing portions of the protective helmet in hidden lines.
Figure 3:
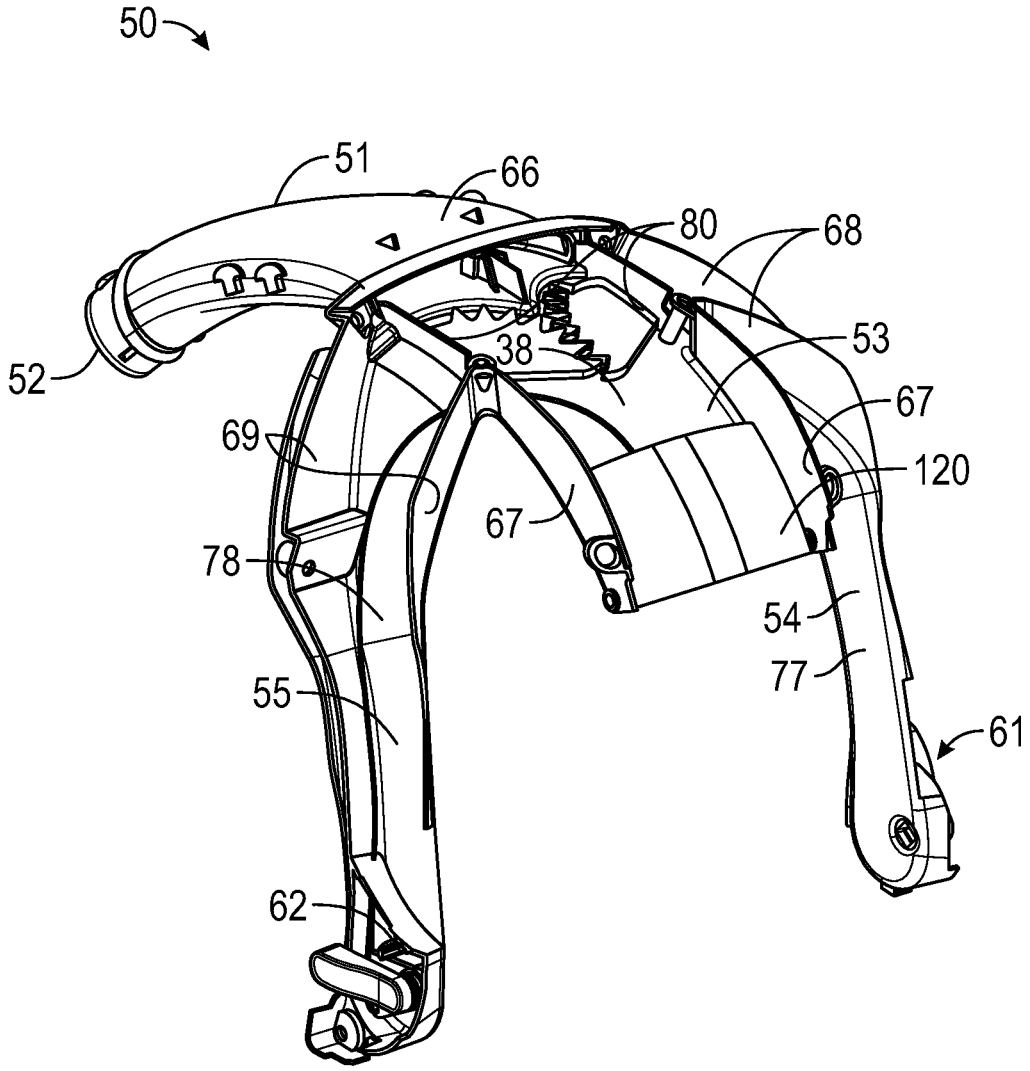
FIG. 3 is a front-right side perspective view of an exemplary air supply module, with the protective helmet omitted completely.

Protective headgear 1 comprises an air supply module 50 that is mounted at least partially within the interior space 31 defined by helmet 20, as shown in exemplary embodiment in FIGS. 2 and 3. In FIG. 2, helmet 20 is shown in partial view in hidden lines so that the relationship of air supply module 50 to helmet 20 can be clearly seen; FIG. 3 is an isolated view of an air supply module 50 with helmet 20 and other components of headgear 1 omitted completely.

Air supply module 50 comprises a laterally central trunk 53, a left lateral trunk 54, and a right lateral trunk 55, e.g. as shown in FIGS. 2 and 3. In at least some embodiments, central trunk 53 comprises an inward major wall 38, from which sidewalls 67 extend outwardly. At least a portion (e.g. a forward portion) of central trunk 53 will not comprise an outward major wall, as is evident from FIG. 3. Similarly, left lateral trunk 54 comprises an inward major wall 77 and sidewalls 68, and right lateral trunk 55 comprises an inward major wall 78 and sidewalls 69 (all as shown in FIG. 3); at least a portion of the left and right lateral trunks will not comprise an outward major wall. Such a design can provide that when air supply module 50 is fitted in place within interior space 31 of helmet 20, designated areas of inward major surface 32 of helmet 20 will provide the "missing" walls so that air passages can be formed. That is, when air supply module 50 is mated to the inside of helmet 20, designated areas 33, 34, and 35 of inward major surface 32 of helmet 20 can act in combination with the central, left and right trunks 53, 54 and 55 of air supply module 50 to respectively define central, left and right air supply passages 56, 57 and 58, all as shown in FIG. 2. Such arrangements can provide that air can be supplied to a wearer of the headgear, while minimizing the total weight of the headgear.

Air supply module 50 may be made of any suitable material, e.g. an organic polymeric injection-molded material, and may be comprised of a single molded main body or may be an assembly of separately-made (e.g. molded) parts. Air supply module 50 may be attached to helmet 20 in any suitable manner, e.g. by the use of mechanical fasteners such as screws, nuts, bolts, clips, clamps, and so on, by press-fitting or snapping, and/or by the use of adhesives, solvent bonding, and so on. In some embodiments, a rearward portion of air supply module 50 (e.g., a portion that defines an air inlet passage 51) may protrude at least partially rearward out of interior space 31 defined by helmet 20, as shown in FIG. 1.

In some embodiments, air supply module 50 comprises an air valve 80 as indicated in FIG. 3. Air valve 80 will control the rate at which air that is received by air supply module 50 through air inlet passage 51, is directed into central air supply passage 56 in comparison to the rate at which air is directed into the left and right lateral air supply passages 57 and 58. Air valve 80 is actuated by a handle 70 (most easily seen in FIGS. 4 and 8). In some embodiments handle 70 may serve to actuate air valve 80 e.g. by electronic, wireless, and/or fiber-optic communication. However, in many convenient embodiments handle 70 may actuate air valve 80 mechanically, e.g. by the use of a cable as described below.

By definition, handle 70 is an external handle, meaning that at least a portion of handle 70 is positioned outward of helmet 20 so that handle 70 can be accessed and manipulated (e.g. by the fingers of a person wearing the protective headgear) during the time that headgear 1 is actually in use, without having to remove helmet 20. Furthermore, an external handle as defined herein is not obstructed or covered by any portion of the headgear, or by any item associated with the headgear, that is not specifically designed to be readily and easily movable to allow the handle to be accessed during the time that the headgear is in actual use. Thus, by way of specific example, handle 216 as disclosed in U.S. Pat. No. 6,393,617 to Paris is not an external handle as defined herein since in use of the '617 headgear the handle is covered by a garment that is not intended to be removed during use of the '617 headgear.

By definition, handle 70 is a remote handle that is remotely connected to air valve 80. By this is meant that handle 70 is located at least 50 mm away from air valve 80 and is not attached directly to any portion of the air valve itself. By this is further meant that handle 70 is connected to air valve 80 in such manner that movement of handle 70 does not result in a an exactly commensurate movement of a major component of air valve 80. In other words, a remote handle as defined herein does not encompass e.g. a handle that is mounted on the same shaft as an air valve so that movement (e.g. pushing, pulling, or rotation) of the handle causes an exactly commensurate movement of a portion of the air valve.

In the embodiment depicted in FIG. 4, handle 70 is remotely connected to air valve 80 (specifically, to an air director 81 of air valve 80 as described below) by a cable 71, a first end 72 of which is attached to handle 70 and a second end 73 of which is attached to air director 81. In the depicted embodiment of FIG. 4, cable 71 follows an arcuate path whose directional change is such that a pivotally downward movement of handle 70 will cause a generally laterally outward movement of air director 81 of air valve 80. In some embodiments, cable 71 may be routed at least partially through a lateral air supply passage (in the exemplary embodiment of FIG. 4, cable 71 is routed through the left lateral air supply passage). It will be appreciated that such an arrangement can advantageously provide that cable 71 is protected by the walls of the air supply passage and is thus prevented from e.g. snagging on hair, fingers or anything else that might enter interior space 31 of helmet 20. In various embodiments, at least about 40, 50, 60, 70, 80, or 90 percent of the elongate length of cable 71 may be routed through, and positioned within, a lateral air supply passage.

In the depicted embodiment of FIG. 4, air valve 80 comprises an air director 81 that comprises a base 82 that is pivotally mounted on (e.g. pivotally attached to) the air supply module. In the exemplary arrangement of FIG. 4, base 82 is pivotally attached to inward major wall 38 of central trunk 53 of air supply module 50. Base 82 comprises an air dam 84 that extends outward from base 82. In the depicted embodiment, air director 81 is a first air director and air valve 80 further comprises a second air director 91. Rather than each air director being operated separately (e.g. by the manipulation of two separate handles), in the depicted embodiment first air director 81 is a "leader" air director and second air director 91 is a "follower" air director. In other words, moving "leader" air director 81 by manipulation of handle 70 causes "follower" air director 91 to be moved automatically along with "leader" air director 81, without the need to manipulate a separate handle. In the exemplary arrangement of FIG. 4, this is achieved by providing follower air director 91 with a base 92 that is pivotally mounted to air supply module 50, from which base extends an air dam 94. Base 92 of follower air director 91, and base 82 of leader air director 81, are each geared to respectively comprise intermeshing teeth 93 and 83. Thus, movement of base 82 of leader air director 81 causes base 92 of follower air director 91 to move.

Figure 5:
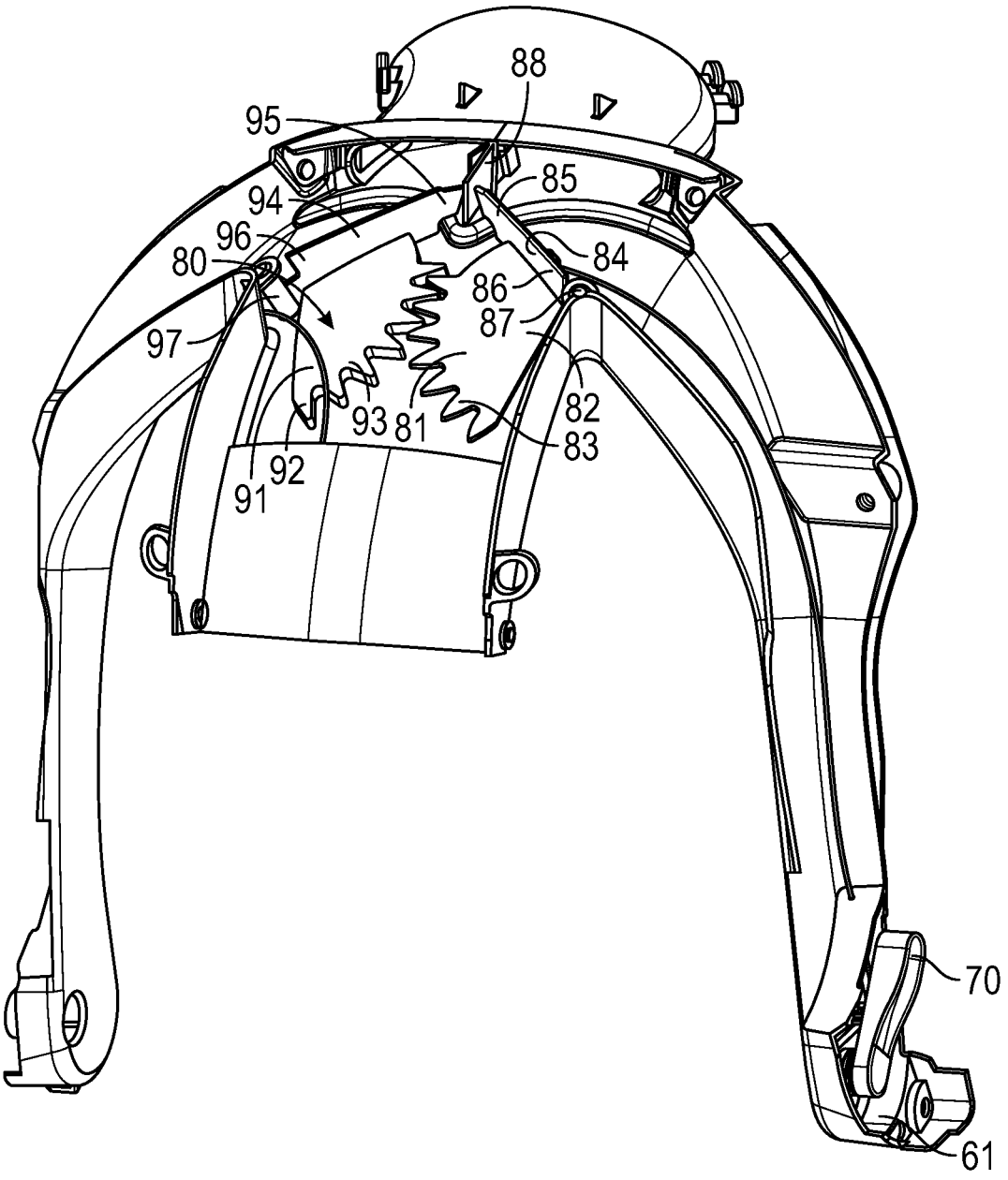
FIG. 5 is a front-left side perspective view of an exemplary air supply module, with an exemplary air valve of the air supply module in a configuration in which air is directed to enter left and right lateral air supply passages of the air supply module.

Comparison of FIGS. 4 and 5 illustrates how the above arrangements can allow the airflow down air inlet passage 51 to be directed into central air supply passage 56, can allow the airflow to be directed down left and right lateral air supply passages 57 and 58, or can allow the airflow to be split between the central passage and the lateral passages, as desired. In FIG. 4, remote handle 70 has been actuated (downward) to pull cable 71 to rotate leader air director 81 about its axis of rotation 87 so that air dam 84 of director 81 is positioned to serve as a continuation of one sidewall 67 of central trunk 53. Due to the intermeshing teeth, this rotation of leader air director 81 has caused counter-rotation of follower air director 91 about its axis of rotation 97 in an opposite direction from that of leader air director 81, so that air dam 94 of director 91 is positioned to serve as a continuation of a second, opposing sidewall 67 of central trunk 53. Thus, air dams 84 and 94, when positioned in this arrangement, block the entrance of air into left or right lateral air passages 57 and 58 and cause substantially all of the airflow to be directed into central air passage 56. In such a configuration, the air dams 84 and 94 of the respective air directors may be at least generally, substantially, or essentially parallel to each other.

If desired by a wearer of the protective headgear, handle 70 can be moved to rotate leader air director 81 to the configuration shown in FIG. 5. The intermeshing teeth will cause follower air director 91 to be counter-rotated to the configuration of FIG. 5. The air directors are thus placed into a configuration in which much or all of the airflow is directed into left and right lateral air passages 57 and 58 rather than being directed into central air passage 56. In the depicted embodiment, this is achieved by moving the air directors into a configuration in which the upstream end 95 of air dam 94 of follower air director 91 and the upstream end 85 of air dam 84 of leader air director 81 are proximate to each other; and, in which the downstream end 96 of air dam 94 of follower air director 91 and the downstream end 86 of air dam 84 of leader air director 81 are spaced apart from each other. In other words, the air dams of the air directors are brought into a "V" configuration (with the upstream ends of the air dams providing the apex of the "V") which diverts air away from central air passage 56 and into left and right lateral air passages 57 and 58.

By the upstream ends of the air dams being proximate to each other, and the downstream ends of the air dams being spaced apart from each other, is meant that the distance between the downstream ends is greater than the distance between the upstream ends by a factor of at least 5. In various embodiments this distance ratio may be at least about 6, 8, 12, 16, 20, 30, or 40. In specific embodiments, central trunk 53 may be provided with a central partition 88 at a location at which the upstream ends of the air dams are to be brought together, so that the upstream end of each air dam can closely abut a side surface of the central partition to enhance the diverting of the air into the lateral air passages. It is emphasized that air valve 80 is not required to be movable only into the position of FIG. 4 or the position of FIG. 5. Rather, handle 70 may be operated to put air valve 80 into any position that is intermediate between those of FIGS. 4 and 5; that is, the airflow can be split between central air passage 56, and left and right lateral air passages 57 and 58, in any desired central/lateral ratio.

Such arrangements can provide that air can be directed down a central air passage (so as to be emitted from a central air outlet 63, located e.g. in the vicinity of the wearer's forehead), or can be directed down left and right lateral air passages (so that the air is emitted from left and right air outlets 64 and 65, located e.g. in the vicinity of the wearer's left and right cheeks), as desired. Advantageously, this can be done by manipulation of only a single handle, rather than by having to operate a separate, dedicated handle for each of the lateral air passages. It will be appreciated that air valve 80 as described herein, is distinguished from one-way valves (e.g. flapper valves, umbrella valves, duckbill valves and the like) that serve to allow airflow in one direction but do not allow airflow in an opposing direction.

It will be appreciated that in order for handle 70 to actuate air valve 80 in the exemplary manner described above, handle 70 should be able to push on elongate cable 71 to move the air valve into the arrangement of FIG. 5 rather than merely being able to pull on cable 71 to move the air valve into the arrangement of FIG. 4. Thus, in at least some embodiments, cable 71 may be a push-pull cable. Cable 71, while it may be somewhat flexible, thus may be arranged so that it can be pushed with sufficient force to move air valve 80 as desired, without cable 71 e.g. bowing or buckling rather than slidably moving in the desired direction. Thus, cable 71 may be made of e.g. metal, e.g. aluminum or steel, of any desired stiffness. To further enhance this push-pull functionality, in some embodiments cable 71 may be slidably disposed within a cable housing (e.g. a shroud or jacket, e.g. so that the cable corresponds to that type of cable generally referred to as a Bowden cable) that extends along at least about 30, 40, 50, 60, 70, 80, or 90% of the elongate length of the cable. Such a housing may ensure that the cable slidably moves when pushed, rather than e.g. bowing or buckling. However, in some embodiments such a cable housing may not be necessary. Rather, one or more cable restraints may be provided, e.g. spaced along the elongate length of cable 71 as desired, which may achieve a similar effect. Such cable restraints may take any form in which the cable is seated in the restraint in such manner that the cable can slidably move through the restraint as needed, but with the restraint preventing the cable from bowing or buckling. In some embodiments such a cable restraint may completely encircle the cable; e.g. it may take the form of an eyelet, grommet, or aperture. In other embodiments the cable restraint may only partially encircle the cable; e.g. it may take the form of a notch, hook, gap, or channel. In some embodiments, one or more such cable restraints may be components that are made separately from air supply module 50 and are then attached thereto. In other embodiments one or more such cable restraints may be conveniently provided in the form of an aperture, gap, or narrowing provided in (e.g. molded into) a component of air supply module 50 itself. One such exemplary aperture 76 is illustrated in FIG. 4 and is discussed in detail later herein.

It will be appreciated that the use of a push-pull cable can eliminate the need to use two or more cables (e.g. as connected to either end of a rocker handle, each cable operating purely in pull mode rather than in push-pull mode). However, arrangements involving multiple cables (e.g. pull-only cables) can be used if desired. It will also be appreciated that a remote handle may be operatively connected to an air valve e.g. by a series of rigid rods (e.g. with appropriate gearing to change the direction of motion of the actuation as needed), if desired. Also, while handle 70 has been discussed in terms of a handle that is pivotally movable and is pivotally attached to a lateral trunk of the air supply module, in various embodiments such a handle may be e.g. slidably movable rather than pivotally movable.

Cable 71 may be attached to handle 70 and to air director 81 in any desired manner (in the Figures, the attachments of cable 71 to handle 70 and director 81 are shown in generic representation for ease of presentation). In some embodiments, second end 73 of cable 71 may be attached to air dam 84 of air director 81 (in the exemplary design of FIG. 4, air dam 84 is provided with a small eyelet for this purpose). In some embodiments, air director 81 may comprise an extender arm that protrudes from any suitable location of director 81, to which arm second end 73 of cable 71 may be attached. Regardless of the specific mode of attachment, second end 73 of cable 71 may be advantageously connected to air director 81 at a distance sufficiently far from an axis of rotation of director 81 that adequate lever arm is present for cable 71 to move director 81 as desired.

As noted above, air supply module 50 comprises left and right lateral trunks 54 and 55. In some embodiments, handle 70 may be pivotally attached to a lower end portion of a lateral trunk rather than being pivotally attached to helmet 20. Thus in the exemplary embodiment of FIG. 4, handle 70 is provided at the lower end of left lateral trunk 54 and is pivotally attached to trunk 54. Such arrangements may simplify the manufacture of helmet 20, since all that may be needed is e.g. to provide an orifice in a lateral side of helmet 20 through which a shaft on which handle 70 is mounted can pass. In the particular arrangement of FIG. 4, a partition 75 is provided toward the lower end of left lateral trunk 54, beneath which handle 70 is mounted. Partition 75 thus provides a terminal end of left air passage 57 so that air that flows down passage 57 is deflected by partition 75 so that the air exits through outlet 64 as desired. Cable 71 can pass through a small aperture 76 in partition 75 as noted previously, which partition may be appropriately sized relative to the size (diameter or equivalent diameter) of cable 71 to minimize any passage of air through the aperture. It will be appreciated that such arrangements allow handle 70 to be positioned externally of helmet 20 so that the handle can be accessed by a wearer of the headgear, while minimizing any escape of air from air passage 57 to the outside of helmet 20.

In some embodiments, upon mating air supply module 50 to helmet 20, handle 70 may be recessed relative to helmet 20, meaning that at least a laterally inward portion of handle 70 is positioned within a laterally outwardly-open-ended cavity provided for this purpose on a lateral side of helmet 20. (An exemplary open-ended cavity of helmet 20 is visible as cavity 37 in FIG. 1; handle 70 is positioned in a similar cavity 36 which is not directly visible in the view of FIG. 1, but is visible in the view of FIG. 8).

In some embodiments, handle 70 (and optional handle 110 as discussed later herein) may be located on a lateral side of helmet 20, e.g. on a lower area of a lateral side as exemplified in FIGS. 1 and 8). It will be appreciated that such a handle may be easier to reach and manipulate than, for example, a handle located on the top or rear of the helmet.

In some embodiments, handle 70 may be configured so that it can be moved continuously (i.e., smoothly, without interruption) over its entire range of motion (e.g. between the positions corresponding to FIGS. 4 and 5). In other embodiments, handle 70 and/or or air valve 80 may be configured so that handle 70 and air valve 80 may be moved in discrete increments, e.g. between two, three, four, five, or more specific positions, rather than being continuously movable. For example, one or more of detents, pawls, cogs, or any other type of interrupters, may be used to provide the desired incremental motion. It will be further appreciated that air valve 80, cable 71, and handle 70 may be collectively configured so that handle 70 can be easily manipulated (e.g. by a user wearing gloves) without requiring excessive force. At the same time, these components should not be so easy to move that, for example, the components of air valve 80 may be moved merely by the pressure of the airflow itself. Accordingly, a desired amount of internal friction may be built into the system, whether dominated by one particular component, or whether provided collectively by multiple components. It will be appreciated that one or more of the previously-described cable restraints, apertures, or the like, may serve such a purpose in addition to restraining the cable from bowing or buckling.

Figure 6:
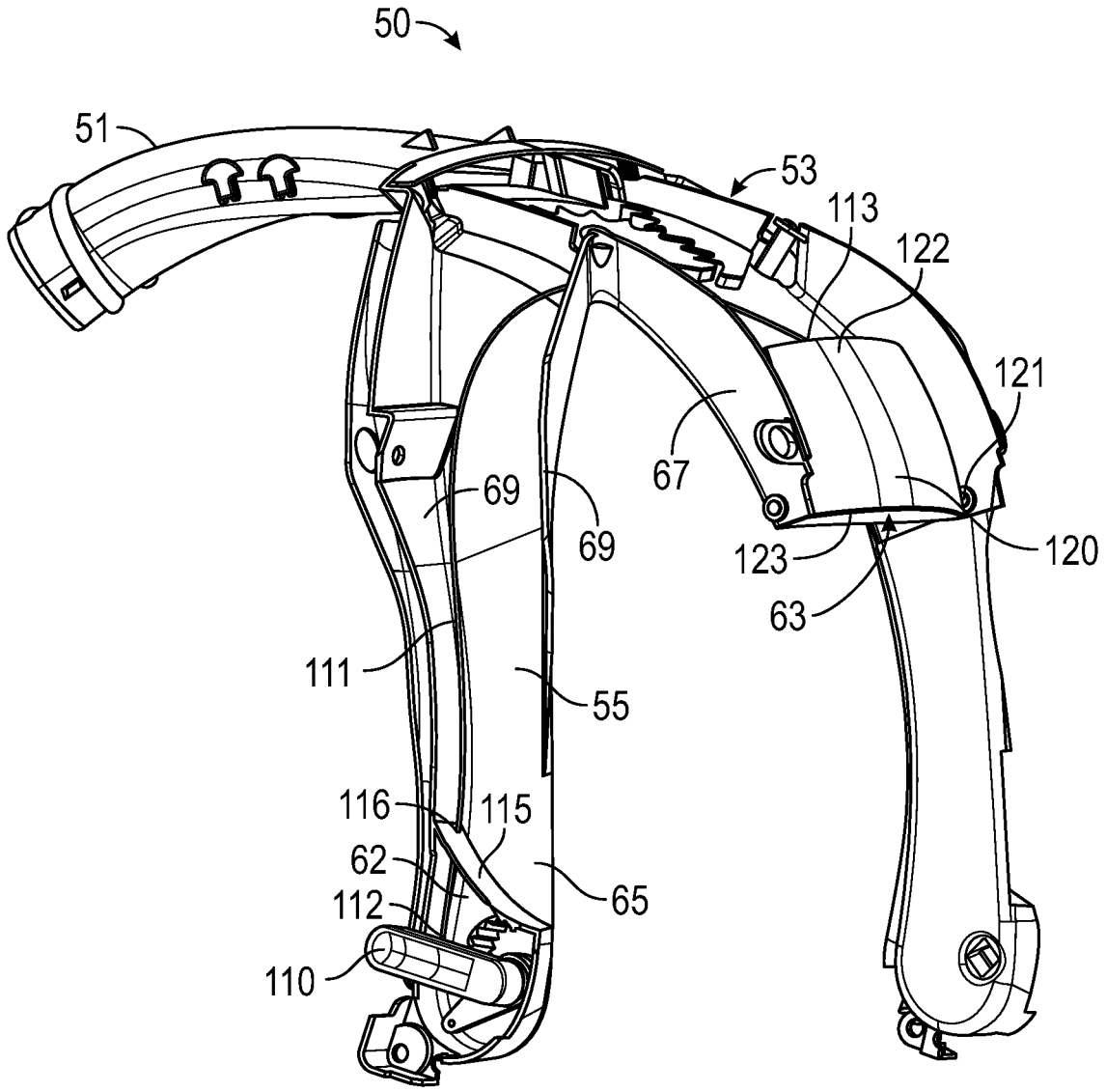
FIG. 6 is a front-right side perspective view of an exemplary air supply module, with an exemplary air deflector of the air supply module in a configuration in which air that is emitted from an outlet of the central air supply passage of the air supply module, is directed generally toward a visor of the protective helmet.
Figure 7:
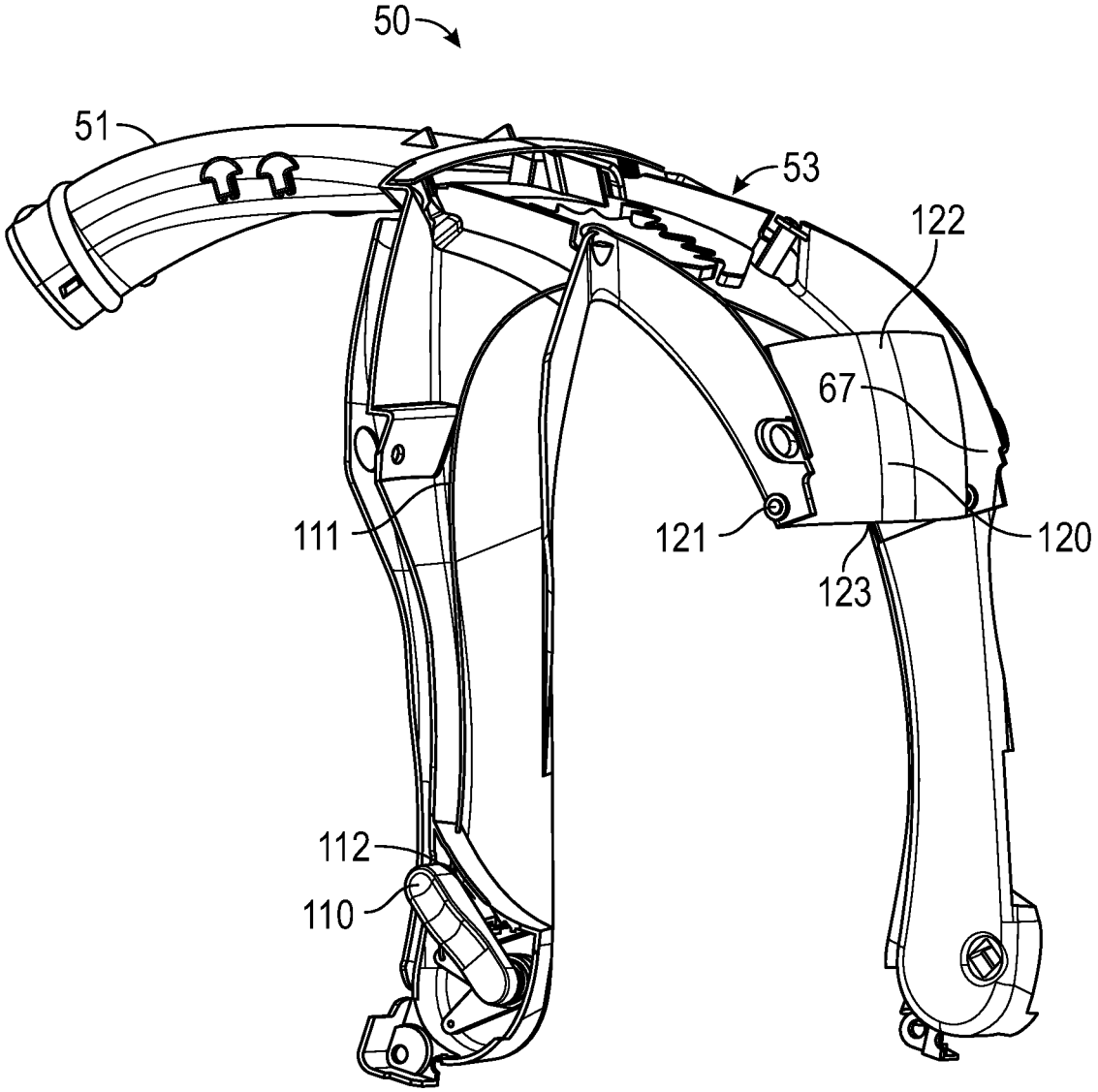
FIG. 7 is a front-right side perspective view of an exemplary air supply module, with the air deflector in a configuration in which air that is emitted from the outlet of the central air supply passage of the air supply module, is directed generally toward a face of the wearer of the protective headgear.

Arrangements have been described above that allow air to be directed into a central air passage 56, to be directed into left and right lateral air passages 57 and 58, or to be split between the central air passages and the lateral air passages, as desired. In some embodiments the air that is directed into the central air passage 56 may be further adjusted. Specifically, the direction in which at which the air is emitted from outlet 63 of central air passage 56 may be adjusted by use of an optional air deflector 120, as shown in FIGS. 6 and 7. Optional air deflector 120 may be configured to move between at least a first position (illustrated in exemplary embodiment in FIG. 6) which causes air to be emitted from outlet 63 in a direction generally toward window 27 of helmet 20, and a second position (illustrated in exemplary embodiment in FIG. 7) which causes air to be emitted from outlet 63 in a direction generally toward the face of a wearer of the protective headgear. In other words, when air deflector 120 is in the first position it causes the air to be emitted in a more forward direction; when air deflector 120 is in the second position it causes the air to be emitted in a more downward direction. Such arrangements can allow that, for example, air can be directed toward the wearer's face for optimum cooling, but can provide that air can be directed toward the helmet window e.g. in the event that defogging of the windowpane is needed.

Air deflector 120 may be positioned proximate to outlet 63 to enable this functionality. In some embodiments at least a portion of air deflector 120 may reside within central air passage 56 upstream from outlet 63; in some embodiments at least a portion of air deflector 120 may protrude beyond outlet 63 of deflector 120. In the embodiment shown in FIGS. 6 and 7, air deflector 120 is pivotally attached to central trunk 53 (specifically, it is pivotally connected to sidewalls 67 of central trunk 53 by pivotal connection 121). The pivotal connection is arranged so that deflector 120 pivots about a rotation axis that is proximate its downstream end 123, thus allowing the upstream end 122 of deflector 120 to be moved between the positions shown in FIGS. 6 and 7. These positions allow a lesser (as in FIG. 6) or greater (as in FIG. 7) proportion of the airflow emitted through central air outlet 63 to be deflected downward, toward the face of a wearer of the headgear. It will be appreciated that the particular arrangement depicted in FIGS. 6 and 7 may allow at least some non-zero proportion of the airflow to always be directed toward the face of the wearer, and some non-zero proportion of the airflow to always be directed toward the helmet windowpane. In other embodiments, it may be possible to direct substantially or essentially all of the airflow in one or the other of these general directions. Furthermore, in some embodiments air deflector 120 may move between at least first and second positions in a back-and-forth slidable manner rather than in a pivotal manner. In some embodiments, central air outlet 63 may be bifurcated into two (e.g. left and right) openings; in such embodiments air deflector 120 may comprise jointly operable (e.g. pivotable) left and right sections that are respectively positioned to deflect the air in each opening of the outlet.

Air deflector 120, if present, is actuated by a handle 110 as seen e.g. in FIGS. 6 and 7. Thus in embodiments in which an operable air deflector 120 is present, handle 110 will be a secondary handle and the previously-described handle 70 will be a primary handle (and the associated cable 71 will be a primary cable). In many embodiments, secondary handle 110 will be an external handle and a remote handle (e.g., it may be of similar or the same design as handle 70). Handle 110 may be remotely connected to air deflector 120 by a secondary cable 111, a first end 112 of which is attached to handle 110 and a second end 113 of which is attached to air deflector 120. Cable 111 follows an arcuate path as is evident from FIG. 5, which directional change is such that a pivotally downward movement of handle 110 will cause a generally rearward movement of upstream end 122 of air deflector 120. In some embodiments, cable 111 may be routed at least partially through a lateral air supply passage (in the exemplary embodiment of FIG. 6, cable 111 is routed through the right lateral air supply passage). In various embodiments, at least about 40, 50, 60, 70, 80, or 90 percent of the elongate length of cable 111 may be routed through, and positioned within, a lateral air supply passage. In various embodiments, secondary cable 111 may be configured as a push-pull cable; and, one or more of a cable housing, cable restraints, and so on may be present, in the manner described previously with regard to primary cable 71.

Secondary handle 110 may be configured for continuous motion e.g. between the two positions depicted in FIGS. 6 and 7; or it may be configured for any number (e.g. two, three, four or five) of discrete incremental movements. And, as is evident from FIG. 1, handle 110 may be recessed in the manner described previously. In some embodiments, secondary remote handle 110 may be pivotally attached to a lower end portion of a left or right lateral trunk rather than being pivotally attached to the helmet itself. Thus in the exemplary embodiment of FIG. 6, handle 110 is provided at the lower end of right lateral trunk 55 and is pivotally attached to trunk 55. In the particular arrangement of FIG. 5, a partition 115 is provided toward the lower end of right lateral trunk 55, beneath which handle 110 is mounted. Partition 115 thus provides a terminal end of right air passage 58 so that air that flows down passage 58 is deflected by partition 115 so that the air exits through outlet 65 as desired. Secondary cable 111 can pass through a small aperture 116 in partition 115, which partition may be appropriately sized to minimize any passage of air loss through the aperture. Such arrangements allow secondary handle 110 to be positioned externally of helmet 20 so that it can be accessed by a wearer of the headgear, while minimizing any escape of air from air passage 58 to the outside of helmet 20.

As noted, air supply module 50 is mounted at least partially within the interior space 31 defined by helmet 20. In some embodiments, a rearward portion of air supply module 50, that defines at least a portion of an air inlet passage 51 and that comprises air inlet opening 52, may protrude rearward out of interior space 31 as in the exemplary design of FIGS. 1 and 2. Air supply module 50 may be mated to helmet 20, and attached thereto, in any suitable manner as noted earlier. In some embodiments, air supply module 50 may be mated to helmet 20 without any resiliently compressible elastomeric seal, cushion or gasket being provided at any location at which a portion of air supply module 50 abuts against a portion or component (e.g. inward major surface 32) of helmet 20. (It will be appreciated that since the various air passages described herein will typically be under positive pressure, it may not be necessary to e.g. achieve a hermetic seal at such locations, although in some embodiments this may be done if desired.) In some embodiments at least the central trunk and the lateral trunks of air supply module 50, including all components mounted thereon (e.g. air directors and deflectors, handles, cables, and so on), do not include any resiliently compressible elastomeric seals, cushions or gaskets. (In this context, resiliently compressible is defined as exhibiting a Shore A hardness of less than 40.) In particular, in such embodiments no such seal, cushion or gasket may be needed to prevent air leaks resulting from the external placement of handle 70 (and handle 110 if present). It will be appreciated that these factors may simplify the design and assembly of headgear 1.

Figure 8:
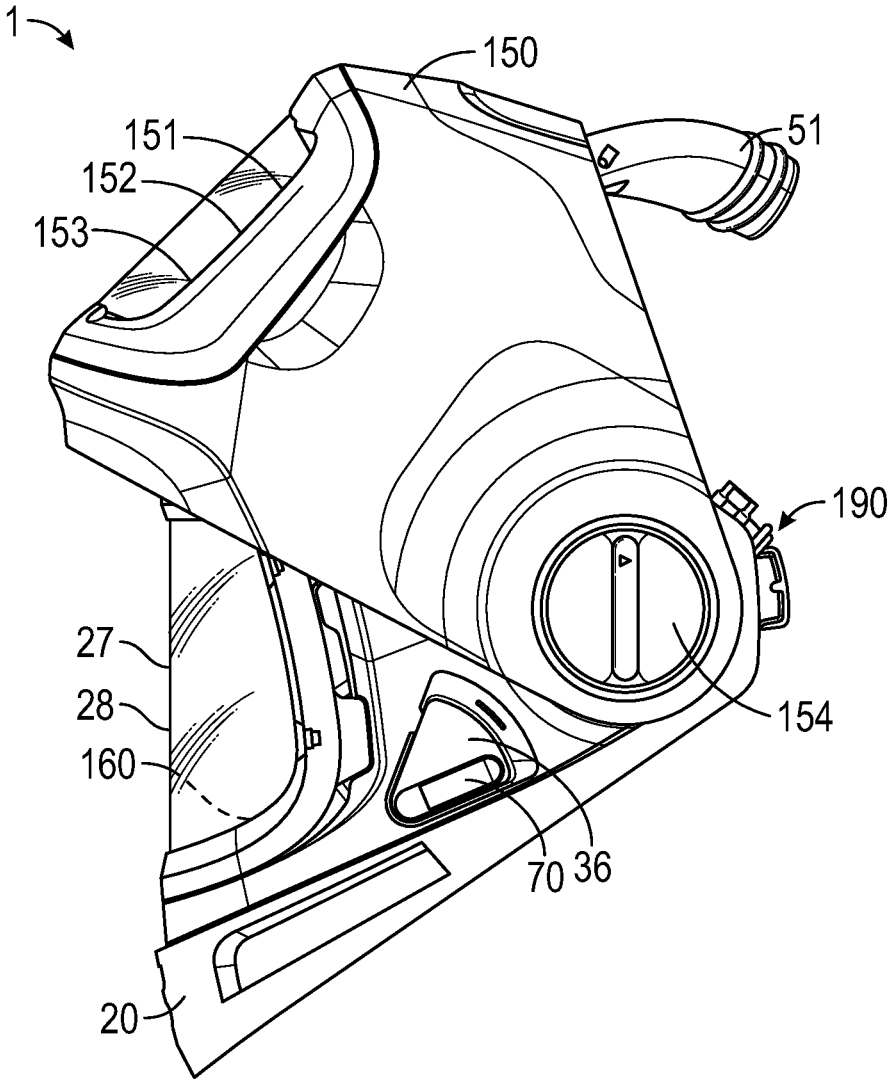
FIG. 8 is a side perspective view of a protective headgear that comprises an exemplary vision-protective visor that is pivotally mounted to the protective helmet of the protective headgear.

In some embodiments, protective headgear 1 may include a suspension 190, a portion of which is visible in exemplary embodiment in FIG. 8. Suspension 190 may comprise any item or combination of items that allows the weight of helmet 20 to be supported by the wearer's head, and may be e.g. attached to helmet 20 in any suitable manner. Any suspension of any suitable design may be used, and may comprise any combination of e.g. straps, bands, and/or pads (e.g. brow bands, crown bands, occipital bands, neck bands, chin straps, and so on). In some embodiments, such a suspension may include one or more pads provided e.g. on inward major surface 32 of helmet 20 and/or on the underside of inward major wall 38 of air supply module 50, which pad or pads may serve a protective and/or cushioning function.

In some embodiments, helmet 20 may be a full-coverage helmet that includes a rigid rear section that covers at least a portion of the rear of the wearer's head. In some embodiments, helmet 20 may be at least partially open toward the rear, and if desired a flexible rear covering (made e.g. of fabric, canvas or the like) may be provided and may be attached e.g. to rearward edges of helmet 20 and/or to any suitable component or portion of air supply module 50.

In at least some embodiments, headgear 1 comprises a face seal 160 that is provided at least partially within interior space 31 defined by helmet 20. Face seal 160 can comprise a material that is flexible and resilient so that it can conform to the user's face, and can contact portions of the face of the wearer of the headgear in order to establish a space (e.g. generally between the wearer's face and the windowpane of the helmet) into which air (e.g. filtered air) is delivered through any or all of the aforementioned air outlets. Suitable arrangements may be made for allowing exhaled air to escape this space, e.g. by the provision of one or more exhaust valves if desired.

In some embodiments, air supply module 50 may comprise one or more features that facilitate attachment of a face seal and/or a flexible rear covering to air supply module 50. Such a feature may take the form of e.g. one or more eyelets, grommets, channels, tubes, or the like, through which a cord (e.g. a drawstring) of the face seal or flexible rear covering may be passed. Or, such a feature may include one or more snaps that are configured to mate with complementary snaps provided on the face seal or the flexible rear covering. In various embodiments, a face seal and/or a flexible rear covering may be attached only to air supply module 50, only to helmet 20, or may be attached to both.

In some embodiments headgear 1 may be configured so that helmet 20 is used in a stand-alone configuration in which no other helmet, visor, or the like is present. For example, helmet 20 may comprise a windowpane 28 that is generally or substantially optically transparent so that helmet 20 may be used for industrial operations such as grinding, for surgical operations in which a wearer is to be protected e.g. from fluids and/or particulate matter, for general purpose uses, and so on. Some such operations may require that a person is to be provided with filtered air, and may thus require that headgear 1 perform as a respirator, e.g. a so-called powered-air purifying respirator (PAPR) of the general type available from 3M Company, St. Paul, MN, under the trade designation ADFLO and VERSAFLO. In various embodiments, headgear 1 may meet any applicable performance standards for Personal Protective Equipment. Such standards may include for example, NIOSH and/or OSHA standards for supplied air respirators (e.g. an Assigned Performance Factor (APF) of 25), a Total Inward Leakage of Personal Protective Equipment, and so on. Various aspects of respirators and their use are described e.g. in U.S. Patent Application Publication 2010/0294270 to Curran, which is incorporated by reference herein.

In some embodiments windowpane 28 of helmet 20 may be capable of filtering electromagnetic radiation (e.g., visible light, ultraviolet radiation, infrared radiation, etc.) that passes through window 27. In such applications, helmet 20 may provide vision protection against high-intensity light, e.g. for operations such as welding, brazing, and the like. In some such embodiments, windowpane 28 may comprise one or more passive filters (i.e., filters whose opacity does not change in response to the intensity of light). In some embodiments, helmet 20 may comprise an automatic darkening filter (ADF) in which windowpane 28 comprises at least one switchable shutter that switches e.g. between a light (highly light-transmissive) and a dark (less light-transmissive) state in response to high intensity light, under the operation of a shutter control system.

In some embodiments, rather than windowpane 28 of helmet 20 providing vision protection from high-intensity light, headgear 1 may comprise a secondary visor (which term broadly encompasses e.g. helmets and the like of any suitable design and shape) that provides such a function. That is, in such embodiments windowpane 28 of helmet 20 may be an optically transparent material (e.g. polycarbonate, safety glass, or the like) that provides physical protection against e.g. splashing liquids, particulate matter, and so on. A secondary visor 150 may be provided e.g. in the manner depicted in FIG. 8, in which secondary visor 150 is positioned outwardly of helmet 20 and is pivotally connected to helmet 20 and/or to head suspension 190 by way of any suitable connection 154. Visor 150 can be lowered into an eye-shielding position (in which any light that reaches the wearer's eyes can only do so by passing through a window 151 of the visor) e.g. when operations such as welding are performed. The visor can be pivotally rotated (raised) to a non-eye-shielding position (as in FIG. 8) when vision protection from high intensity light is not needed. Such a visor will be readily and easily movable to a non-eye-shielding position so that a wearer of the headgear can access and operate an external, remote handle of the helmet when desired. Protective headgear of this general type (comprising a helmet in combination with a vision-protective visor that is pivotally coupled to the helmet), include products available from 3M Company under the trade designation SPEEDGLAS 9100-FX-AIR.

Window 151 of visor 150 may comprise e.g. one or more passive electromagnetic radiation filters. In some embodiments visor 150 may comprise an automatic darkening filter 152 comprising at least one switchable shutter 153 positioned in window 151. (Many such automatic darkening filters will also comprise at least one passive filter for the purpose of minimizing ultraviolet radiation, infrared radiation, and so on). Automatic darkening filters and components and uses thereof are described e.g. in U.S. Patent Application Publication 2006/0203148 to Magnusson and in U.S. patent application Ser. No. 15/543,352, entitled Automatic Darkening Filter Apparatus and Method, both of which are incorporated by reference herein.

Visor 150 and helmet 20 may be configured so that when visor 150 is raised to a non-eye-shielding position, external, remote handle 70 (and external, remote handle 110 if present) is exposed e.g. on a lower lateral portion of helmet 20. This can provide that the handle(s) can be accessed merely by moving visor 150 to the non-eye-shielding position, without necessitating that visor 150 or helmet 20 be removed from the wearer's head in order to access the handle.

As noted, air supply module 50 comprises a rearward portion that defines an air inlet passage 51 and that comprises an air inlet opening 52 to which a suitable conduit (e.g. a flexible hose or the like) can be coupled in order to supply air to module 50. It will be appreciated that in the exemplary embodiments depicted herein, air inlet passage 51 is defined by surfaces of the air supply module itself and is not defined by any portion of helmet 20. This is in contrast to central and lateral air passages 56, 57 and 58, which are respectively defined by surfaces of the various trunks of the air supply module and surface areas of the helmet, acting in combination.

Air supply module 50 may receive flowing air from any powered-air source, of any suitable design and of any desired configuration. For example, air inlet opening 52 may be connected to a hose which is connected to a personal powered-air supply apparatus e.g. comprising a belt-mounted device comprising a blower fan. Or, air inlet opening 52 may be connected to a hose which is connected to a remote powered-air supply that is not mounted on the body of the person. Or, a fan may be mounted on headgear 1 itself to deliver air into opening 52. Often, such arrangements are used to supply a person with air that has been filtered to remove particles and/or to remove gases/vapors. Any suitable filter may be used, and may be provided in any suitable location. Thus in some embodiments one or more filters may be located within air supply module 50 itself, e.g. within air inlet passage 51. Alternatively, such a filter may be located e.g. in a belt-mounted device, or at a remote location. Such a filter may rely on any suitable filter media, e.g. chosen from any of the various materials described in U.S. patent application Ser. No. 15/519,888, filed 21 Oct. 2015.

In various embodiments, protective headgear as described herein may be used in connection with industrial operations, for example welding (e.g. arc welding, torch welding, acetylene welding), cutting (e.g. laser cutting, acetylene cutting), brazing, soldering and the like. They may also be used in connection with medical procedures, for example those involving high intensity light (e.g. laser surgery, hair removal, tattoo removal, light-curing of dental resins, etc.) and other uses as well.

LIST OF EXEMPLARY EMBODIMENTS

Embodiment 1 is a protective headgear comprising a protective helmet that defines an interior space, that comprises an inward major surface, and that comprises a forward window with a windowpane; a head suspension that is connected to the helmet; and an air supply module mounted at least partially within the interior space defined by the helmet, wherein the air supply module comprises central, right lateral, and left lateral trunks that are configured so that when the module is mounted within the interior space defined by the helmet, selected central, left and right areas of the inward major surface of the helmet combine with the central, left lateral and right lateral trunks of the air supply module to respectively define a central air supply passage and left and right lateral air supply passages for delivering air to a wearer of the protective headgear, and, wherein the air supply module comprises an external, remote handle that is remotely connected to an air valve that is operative to control a rate at which air is directed into the central air supply passage in comparison to a rate at which air is directed into the left and right lateral air supply passages.

Embodiment 2 is the protective headgear of embodiment 1 wherein the remote handle is a recessed handle that is configured so that at least an inward portion of the handle is positioned within a laterally outwardly-open-ended cavity of a lateral side of the helmet.

Embodiment 3 is the protective headgear of any of embodiments 1-2 wherein the remote handle is a pivotally movable handle that is pivotally attached to a lower end portion of the left lateral trunk or the right lateral trunk of the air supply module rather than being pivotally attached to the helmet.

Embodiment 4 is the protective headgear of any of embodiments 1-3 wherein the remote handle is mechanically connected to the air valve by a cable whose first end is attached to the remote handle and whose second end is connected to a leader air director of the air valve, the leader air director being movable between at least a first position in which air is directed into the central air passage, and a second position in which air is directed into the left lateral air passage or the right lateral air passage.

Embodiment 5 is the protective headgear of embodiment 4 wherein the cable is an elongate, single push-pull cable that is pullable by the remote handle to pull the leader air director in first direction toward the first position, and is pushable by the remote handle to push the leader air director in a second direction opposite the first direction, toward the second position.

Embodiment 6 is the protective headgear of embodiment 5 wherein at least a portion of the push-pull cable is slidably disposed within a cable housing that extends along at least about 30% of the elongate length of the cable; and/or wherein at least one portion of the cable slidably passes through at least one cable restraint provided in the left lateral trunk or the right lateral trunk of the air supply module.

Embodiment 7 is the protective headgear of any of embodiments 4-6 wherein the leader air director of the air valve comprises a base that is pivotally attached to the air supply module and an air dam that extends away from the base.

Embodiment 8 is the protective headgear of embodiment 7 wherein the air valve further comprises a second, follower air director that comprises a base that is pivotally attached to the air supply module and an air dam that extends away from the base, and wherein the base of the follower air director comprises teeth that are intermeshed with teeth of the base of the leader air director so that the base of the follower air director is counter-rotatably drivable by the base of the leader air director, so that as the leader air director is urged by the cable to pivotally move in one direction, the follower air director is urged by the leader air director to pivotally move in an opposite direction.

Embodiment 9 is the protective headgear of embodiment 8 wherein the leader air director and the follower air director are configured so that they are movable at least between a first configuration in which the air dam of the follower air director is at least generally parallel to the air dam of the leader air deflector, in which configuration air is directed into the central air supply passage, and a second configuration in which an upstream end of the air dam of the follower air director and an upstream end of the air dam of the leader air director are proximate to each other and a downstream end of the air dam of the follower air director is spaced apart from a downstream end of the air dam of the leader air director, in which second configuration air is directed into the left lateral air passage and the right lateral air passage.

Embodiment 10 is the protective headgear of any of embodiments 4-9 wherein at least about 70 percent of an elongate length of the cable is routed through, and is positioned within, the left lateral air supply passage or the right lateral air supply passage.

Embodiment 11 is the protective headgear of embodiment 10 wherein the cable passes through an aperture in a partition that defines a lower end of the lateral air supply passage through which the cable is routed, which aperture comprises an open area that is no greater than 150% of a cross-sectional area of the cable at the point at which the cable passes through the aperture.

Embodiment 12 is the protective headgear of any of embodiments 1-11 wherein the remote handle that is remotely connected to the air valve is a primary remote handle and wherein the cable to which the primary remote handle is connected is a primary cable; and wherein the air supply module further comprises a secondary remote handle that is remotely connected to an air deflector that is operable by the secondary remote handle to control a direction in which air is emitted from an outlet of the central air supply passage.

Embodiment 13 is the protective headgear of embodiment 12 wherein the secondary remote handle is a recessed handle that is mechanically connected to the air deflector by way of a secondary cable that is a single, push-pull cable and whose first end is attached to the secondary remote, recessed handle and whose second end is connected to the air deflector; and wherein the air deflector is configured to be moved by the push-pull cable between at least a first position which causes air to be emitted from the outlet of the central air supply passage in a direction generally toward the window of the helmet, and a second position which causes air to be emitted from the outlet of the central air supply passage in a direction generally toward the face of a wearer of the protective headgear.

Embodiment 14 is the protective headgear of embodiment 13 wherein the air deflector is pivotally attached to the central trunk of the air supply module and is pivotally movable between at least the first position and the second position.

Embodiment 15 is the protective headgear of any of embodiments 1-14 wherein the protective headgear further includes a vision-protective visor that is pivotally connected to the helmet and/or to the head suspension, so that the vision-protective visor can be pivotally moved relative to the helmet, between an eye-shielding position and a non-eye-shielding position.

Embodiment 16 is the protective headgear of embodiment 15 wherein the vision-protective visor comprises an automatic darkening filter comprising at least one switchable shutter that is mounted in a forward window of the vision-protective visor.

Embodiment 17 is the protective headgear of any of embodiments 15-16 wherein at least when the vision-protective visor is in the non-eye-shielding position, the remote handle of the air supply module is exposed on a lower lateral portion of the helmet so that it is accessible to the fingers of a wearer of the protective headgear.

Embodiment 18 is the protective headgear of any of embodiments 1-17 wherein the protective headgear further comprises a face seal that is provided at least partially within the interior space defined by the helmet, and that is configured to contact portions of a face of a wearer of the protective headgear to provide a space into which filtered air is delivered through an air outlet of one or more of the air supply passages.

Embodiment 19 is the protective headgear of any of embodiments 1-18 wherein the helmet and the air supply module are each made of injection molded, non-elastomeric thermoplastic resins, wherein at least the central trunk and the left and right lateral trunks of the air supply module do not comprise any resiliently compressible seals, cushions or gaskets, and wherein no resiliently compressible seal, cushion or gasket is provided at any location at which a portion of the air supply module abuts against a portion of the helmet.

Embodiment 20 is the protective headgear of any of embodiments 1-19 wherein the headgear comprises an air inlet passage that is defined by the air supply module and that is not defined by any portion of the helmet, and that is configured to receive flowing air from a powered-air source.

Embodiment 21 is a protective apparatus comprising the protective headgear of embodiment 20 and further comprising a powered-air source and at least one filter that is configured to remove particles and/or gases from the flowing air before the flowing air is delivered to a wearer of the protective headgear.

Embodiment 22 is a protective headgear comprising a protective helmet that defines an interior space, that comprises an inward major surface, and that comprises a forward window with a windowpane; a head suspension that is connected to the helmet; and an air supply module mounted at least partially within the interior space defined by the helmet, wherein the air supply module comprises central, right lateral, and left lateral trunks that are configured so that when the module is mounted within the interior space defined by the helmet, selected central, left and right areas of the inward major surface of the helmet combine with the central, left lateral and right lateral trunks of the air supply module to respectively define a central air supply passage and left and right lateral air supply passages for delivering filtered air to a wearer of the protective headgear.

Embodiment 23 is a protective headgear comprising a protective helmet that defines an interior space, that comprises an inward major surface, and that comprises a forward window with a windowpane; a head suspension that is connected to the helmet; and an air supply module mounted at least partially within the interior space defined by the helmet, wherein the protective headgear comprises a central air supply passage and left and right lateral air supply passages for delivering filtered air to a wearer of the protective headgear, and, wherein the air supply module comprises an external, remote handle that is remotely connected to an air valve that is operative to control a rate at which air is directed into the central air supply passage in comparison to a rate at which air is directed into the left and right lateral air supply passages.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document incorporated by reference herein, this specification as written will control.

This application is a continuation of U.S. patent application Ser. No. 16/648,188, now U.S. Pat. No. 11,253,022, which was a 371 of International Patent Application No. PCT/IB2018/056889, which claimed priority to U.S. Provisional Patent Application No. 62/561,905, the disclosures of all of which are incorporated by reference in their entirety herein.

What is claimed is:

1. A protective headgear comprising:

a protective helmet that defines an interior space, that comprises an inward major surface, and that comprises a forward window with a windowpane;

a head suspension that is connected to the helmet;

and an air supply module mounted at least partially within the interior space defined by the helmet, wherein the air supply module comprises central, right lateral, and left lateral trunks that are configured so that the central trunk, the right lateral trunk, and the left lateral trunk each comprise an inward major wall from which sidewalls extend outwardly, but with at least a portion of the central trunk, the right lateral trunk, and the left lateral trunk not comprising an outward major wall, so that selected central, left and right areas of the inward major surface of the helmet combine with the central, left lateral and right lateral trunks of the air supply module to respectively define a central air supply passage and left and right lateral air supply passages for delivering air to a wearer of the protective headgear.

2. The protective headgear of claim 1 wherein the air supply module comprises an external, remote handle that is remotely connected to an air valve that is operative to control a rate at which air is directed into the central air supply passage in comparison to a rate at which air is directed into the left and right lateral air supply passages.

3. The protective headgear of claim 2 wherein the remote handle is a recessed handle that is configured so that at least an inward portion of the handle is positioned within a laterally outwardly-open-ended cavity of a lateral side of the helmet, and wherein the remote handle is mechanically connected to the air valve by a cable whose first end is attached to the remote handle and whose second end is connected to a leader air director of the air valve, the leader air director being movable between at least a first position in which air is directed into the central air passage, and a second position in which air is directed into the left lateral air passage or the right lateral air passage.

4. The protective headgear of claim 2 wherein the remote handle is a pivotally movable handle that is pivotally attached to a lower end portion of the left lateral trunk or the right lateral trunk of the air supply module rather than being pivotally attached to the helmet.

5. The protective headgear of claim 2 wherein the remote handle is mechanically connected to the air valve by a cable whose first end is attached to the remote handle and whose second end is connected to a leader air director of the air valve, the leader air director being movable between at least a first position in which air is directed into the central air passage, and a second position in which air is directed into the left lateral air passage or the right lateral air passage, wherein the remote handle that is remotely mechanically connected to the air valve is a primary remote handle and wherein the cable to which the primary remote handle is connected is a primary cable, and wherein the air supply module further comprises a secondary remote handle that is remotely connected to an air deflector that is operable by the secondary remote handle to control a direction in which air is emitted from an outlet of the central air supply passage.

6. The protective headgear of claim 2 wherein the remote handle that is remotely connected to the air valve is a primary remote handle and wherein the cable to which the primary remote handle is connected is a primary cable, wherein the air supply module further comprises a secondary remote handle that is remotely connected to an air deflector that is operable by the secondary remote handle to control a direction in which air is emitted from an outlet of the central air supply passage, and wherein the remote handle is a recessed handle that is configured so that at least an inward portion of the handle is positioned within a laterally outwardly-open-ended cavity of a lateral side of the helmet.

7. The protective headgear of claim 6 wherein the secondary remote handle is a recessed handle that is mechanically connected to the air deflector by way of a secondary cable that is a single, push-pull cable and whose first end is attached to the secondary remote, recessed handle and whose second end is connected to the air deflector; and, wherein the air deflector is configured to be moved by the push-pull cable between at least a first position which causes air to be emitted from the outlet of the central air supply passage in a direction generally toward the window of the helmet, and a second position which causes air to be emitted from the outlet of the central air supply passage in a direction generally toward the face of a wearer of the protective headgear.

8. The protective headgear of claim 7 wherein the air deflector is pivotally attached to the central trunk of the air supply module and is pivotally movable between at least the first position and the second position.

9. The protective headgear of claim 1 wherein the protective headgear further includes a vision-protective visor that is pivotally connected to the helmet and/or to the head suspension, so that the vision-protective visor can be pivotally moved relative to the helmet, between an eye-shielding position and a non-eye-shielding position.

10. The protective headgear of claim 9 wherein the vision-protective visor comprises an automatic darkening filter comprising at least one switchable shutter that is mounted in a forward window of the vision-protective visor.

11. The protective headgear of claim 1 wherein the protective headgear further comprises a face seal that is provided at least partially within the interior space defined by the helmet, and that is configured to contact portions of a face of a wearer of the protective headgear to provide a space into which filtered air is delivered through an air outlet of one or more of the air supply passages.

12. The protective headgear of claim 1 wherein the helmet and the air supply module are each made of injection molded, non-elastomeric thermoplastic resins, with the proviso that at least the central trunk and the left and right lateral trunks of the air supply module do not comprise any resiliently compressible seals, cushions or gaskets, and with the further proviso that no resiliently compressible seal, cushion or gasket is provided at any location at which a portion of the air supply module abuts against a portion of the helmet.

13. The protective headgear of claim 1 wherein the headgear comprises an air inlet passage that is defined by the air supply module and that is not defined by any portion of the helmet, and that is configured to receive flowing air from a powered-air source.

14. A protective apparatus comprising the protective headgear of claim 1 and further comprising a powered-air source and at least one filter that is configured to remove particles and/or gases from flowing air received from the powered-air source before the flowing air is delivered to a wearer of the protective headgear.

15. The protective apparatus of claim 14 wherein the powered-air source and the protective headgear are configured so that the central air supply passage and left and right lateral air supply passages are maintained under positive pressure when the protective apparatus is in operation.

16. The protective apparatus of claim 14 wherein the headgear comprises an air inlet passage that is defined by the air supply module and that is not defined by any portion of the helmet, and that receives the flowing air from the powered-air source by way of a flexible hose that connects the air inlet passage and the powered-air source.

17. The protective headgear of claim 1 wherein the protective helmet of the protective headgear comprises a rigid shell made of an organic polymeric injection-molded material with a Shore A hardness of at least 60 and that is at least partially open toward a rear side of the protective headgear, with the protective headgear further comprising a flexible fabric rear covering.

18. The protective headgear of claim 1 wherein the protective headgear includes a vision-protective visor that is pivotally connected to the protective helmet and/or to the head suspension so that the vision-protective visor can be pivotally moved relative to the protective helmet between a lowered, eye-shielding position of the vision-protective visor and a raised, non-eye-shielding position of the vision-protective visor; wherein the vision-protective visor comprises an automatic darkening filter comprising at least one switchable shutter that is mounted in a forward window of the vision-protective visor; and, wherein the windowpane of the forward window of the protective helmet is an optically transparent material that provides physical protection.

19. The protective headgear of claim 18 wherein the air supply module comprises an external, remote handle that is remotely connected to an air valve that is operative to control a rate at which air is directed into the central air supply passage in comparison to a rate at which air is directed into the left and right lateral air supply passages, the external, remote handle being positioned on a lower lateral side of the protective helmet so that the external, remote handle can be accessed by pivotally moving the vision-protective visor to the raised, non-eye-shielding position of the vision-protective visor.

* * * * *